US011633071B1

(12) United States Patent
Brown

(10) Patent No.: US 11,633,071 B1
(45) Date of Patent: Apr. 25, 2023

(54) COLLAPSIBLE OUTDOOR SHOWER

(71) Applicant: Dexter F. Brown, Jamaica, NY (US)

(72) Inventor: Dexter F. Brown, Jamaica, NY (US)

( * ) Notice: Subject to any disclaimer, the term of this patent is extended or adjusted under 35 U.S.C. 154(b) by 297 days.

(21) Appl. No.: 17/114,681

(22) Filed: Dec. 8, 2020

(51) Int. Cl.
*A47K 3/32* (2006.01)
*E04H 1/12* (2006.01)
*E04H 15/00* (2006.01)

(52) U.S. Cl.
CPC ..... *A47K 3/325* (2013.01); *E04H 1/1205* (2013.01); *E04H 15/003* (2013.01)

(58) Field of Classification Search
CPC ..... A47K 3/325; A47K 3/32; E04H 1/1205; E04H 15/003
USPC ..... 4/599
See application file for complete search history.

(56) References Cited

U.S. PATENT DOCUMENTS 1,049,714 A * 1/1913 Herscovitz ..... A47K 3/325 135/902
1,844,038 A * 2/1932 Hooker ..... A47K 3/285 135/902
3,288,157 A 11/1966 Szkolny
3,391,409 A * 7/1968 Gatley ..... A47K 3/325 4/900
D221,770 S 9/1971 LeBlanc
4,866,794 A 9/1989 Davies
5,205,001 A 4/1993 O'Connell
5,311,620 A 5/1994 Ratje
5,416,933 A * 5/1995 Bernard ..... E04H 4/0006 4/612
5,446,930 A 9/1995 Clark
5,544,639 A * 8/1996 Shouda ..... F01N 9/005 123/676
5,790,992 A * 8/1998 Ray ..... A47K 3/325 4/599
5,970,536 A 10/1999 Suarez
7,047,577 B1 5/2006 Cirilli
9,144,350 B2 9/2015 Guilbeau
10,201,251 B2 * 2/2019 Barrett ..... A47K 3/325
2013/0340159 A1 12/2013 Barrett

FOREIGN PATENT DOCUMENTS

WO 2016099308 6/2016

* cited by examiner

*Primary Examiner* — Huyen D Le
(74) *Attorney, Agent, or Firm* — Kyle A. Fletcher, Esq.

(57) ABSTRACT

The collapsible outdoor shower is a temporary structure. The collapsible outdoor shower is a collapsible structure. The collapsible outdoor shower is configured for outdoor use. The collapsible outdoor shower is deployed to create a private space for a client that is used for showering. The collapsible outdoor shower comprises a superior structure, a capture pan, and a lateral bracing structure. The lateral bracing structure secures the capture pan to the superior structure. The superior structure suspends the collapsible outdoor shower from an externally provisioned structure. The lateral bracing structure forms the private space that encloses the client. The capture pan forms a protected surface on which the client stands while in the private space.

19 Claims, 6 Drawing Sheets

COLLAPSIBLE OUTDOOR SHOWER

CROSS REFERENCES TO RELATED APPLICATIONS

Not Applicable

STATEMENT REGARDING FEDERALLY SPONSORED RESEARCH

Not Applicable

REFERENCE TO APPENDIX

Not Applicable

BACKGROUND OF THE INVENTION

Field of the Invention

The present invention relates to the field of baths and showers, more specifically, a collapsible and movable cabinet for a shower. (A47K3/325)

SUMMARY OF INVENTION

The collapsible outdoor shower is a temporary structure. The collapsible outdoor shower is a collapsible structure. The collapsible outdoor shower is configured for outdoor use. The collapsible outdoor shower is deployed to create a private space for a client that is used for showering. The collapsible outdoor shower comprises a superior structure, a capture pan, and a lateral bracing structure. The lateral bracing structure secures the capture pan to the superior structure. The superior structure suspends the collapsible outdoor shower from an externally provisioned structure. The lateral bracing structure forms the private space that encloses the client. The capture pan forms a protected surface on which the client stands while in the private space.

These together with additional objects, features and advantages of the collapsible outdoor shower will be readily apparent to those of ordinary skill in the art upon reading the following detailed description of the presently preferred, but nonetheless illustrative, embodiments when taken in conjunction with the accompanying drawings.

In this respect, before explaining the current embodiments of the collapsible outdoor shower in detail, it is to be understood that the collapsible outdoor shower is not limited in its applications to the details of construction and arrangements of the components set forth in the following description or illustration. Those skilled in the art will appreciate that the concept of this disclosure may be readily utilized as a basis for the design of other structures, methods, and systems for carrying out the several purposes of the collapsible outdoor shower.

It is therefore important that the claims be regarded as including such equivalent construction insofar as they do not depart from the spirit and scope of the collapsible outdoor shower. It is also to be understood that the phraseology and terminology employed herein are for purposes of description and should not be regarded as limiting.

BRIEF DESCRIPTION OF DRAWINGS

The accompanying drawings, which are included to provide a further understanding of the invention are incorporated in and constitute a part of this specification, illustrate an embodiment of the invention and together with the description serve to explain the principles of the invention. They are meant to be exemplary illustrations provided to enable persons skilled in the art to practice the disclosure and are not intended to limit the scope of the appended claims.

DETAILED DESCRIPTION OF THE EMBODIMENT

The following detailed description is merely exemplary in nature and is not intended to limit the described embodiments of the application and uses of the described embodiments. As used herein, the word "exemplary" or "illustrative" means "serving as an example, instance, or illustration." Any implementation described herein as "exemplary" or "illustrative" is not necessarily to be construed as preferred or advantageous over other implementations. All of the implementations described below are exemplary implementations provided to enable persons skilled in the art to practice the disclosure and are not intended to limit the scope of the appended claims. Furthermore, there is no intention to be bound by any expressed or implied theory presented in the preceding technical field, background, brief summary or the following detailed description.

Figure 1:
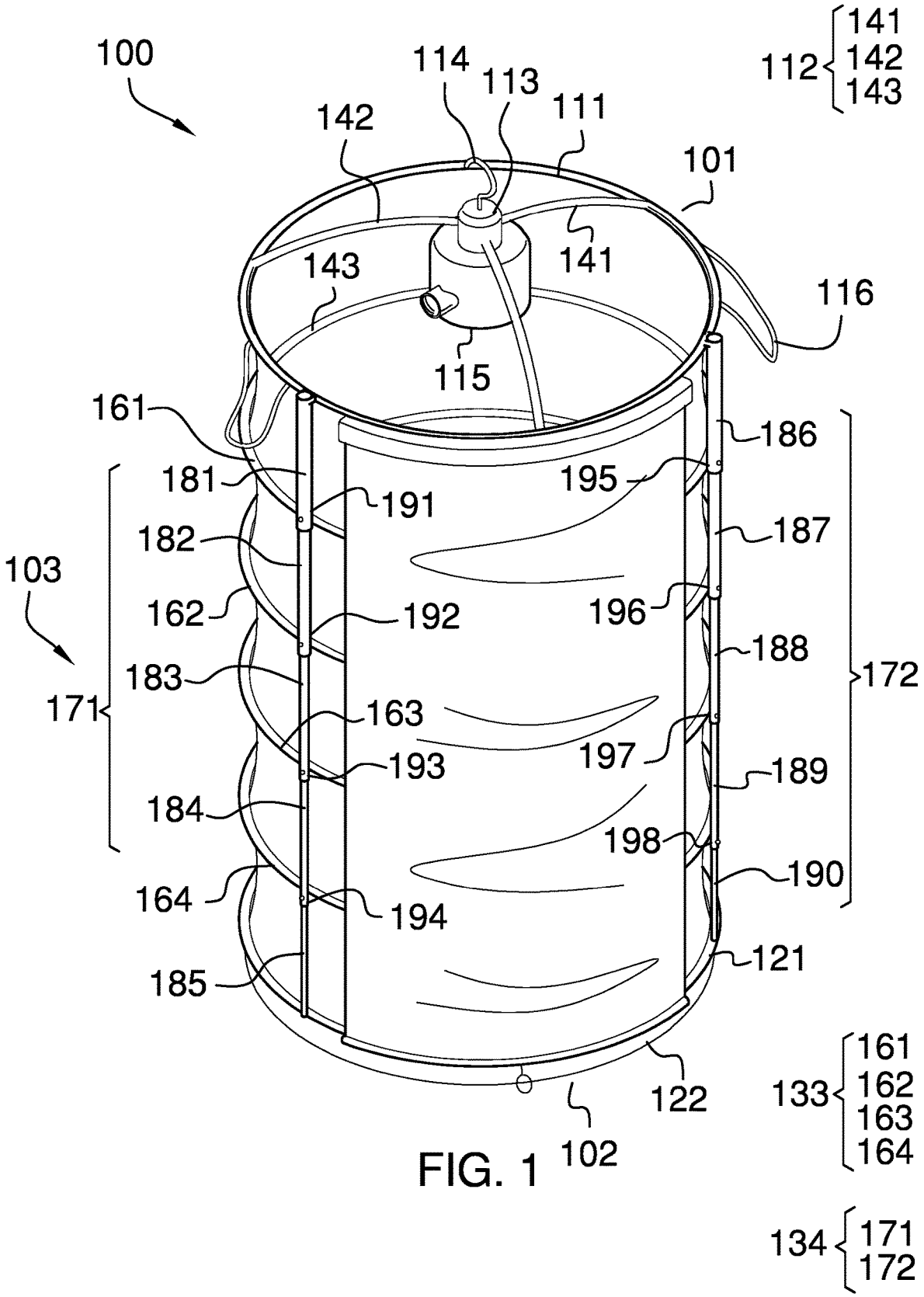
FIG. 1 is a perspective view of an embodiment of the disclosure.
Figure 2:
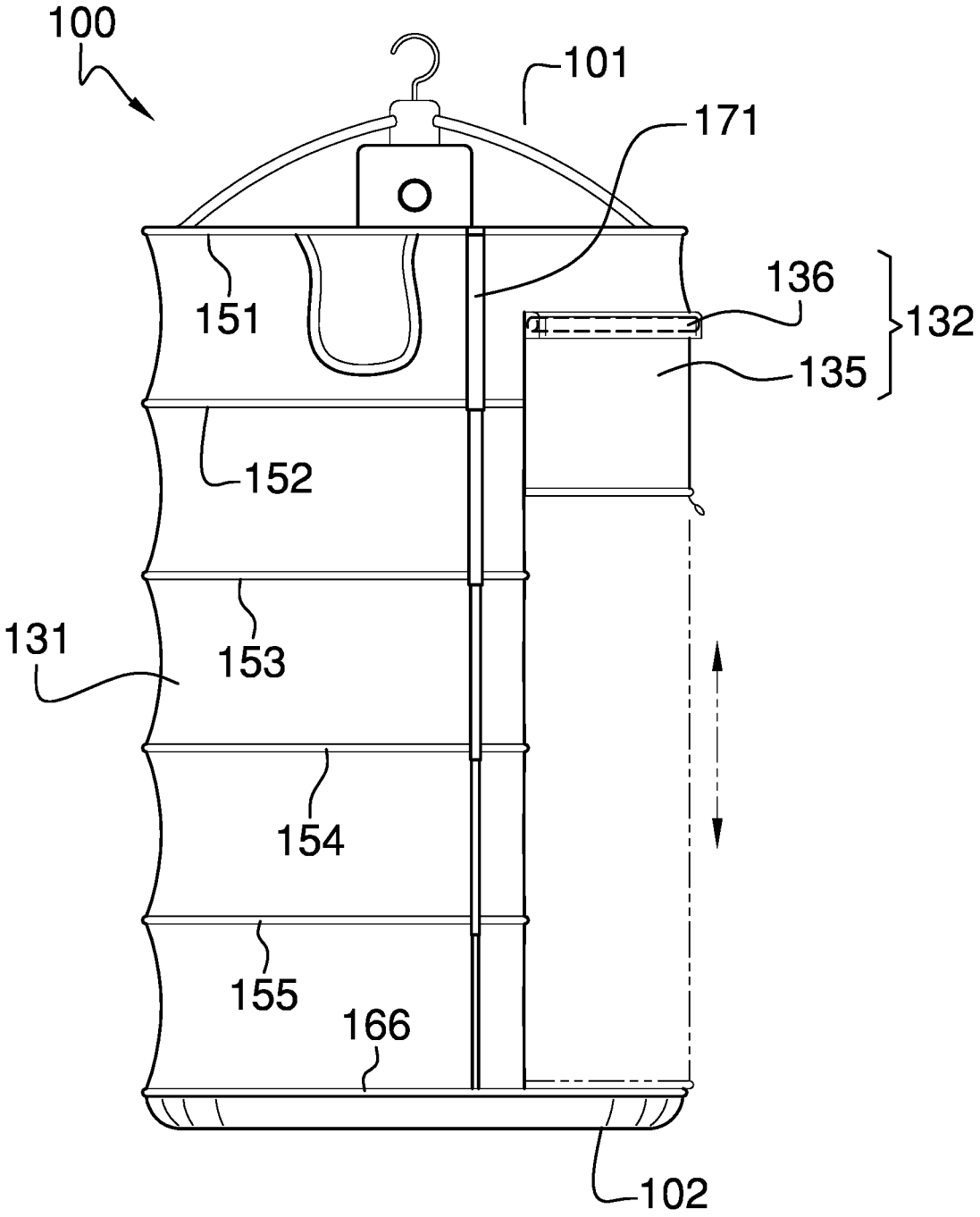
FIG. 2 is a side view of an embodiment of the disclosure.
Figure 3:
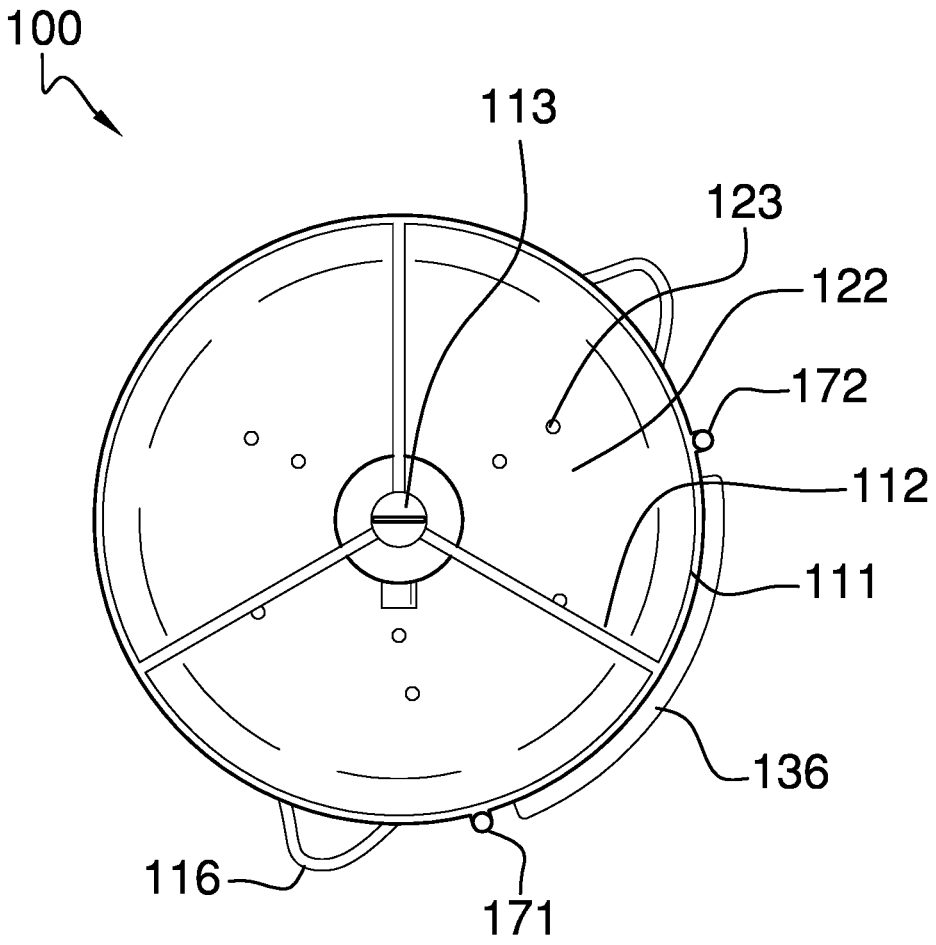
FIG. 3 is a top view of an embodiment of the disclosure.
Figure 4:
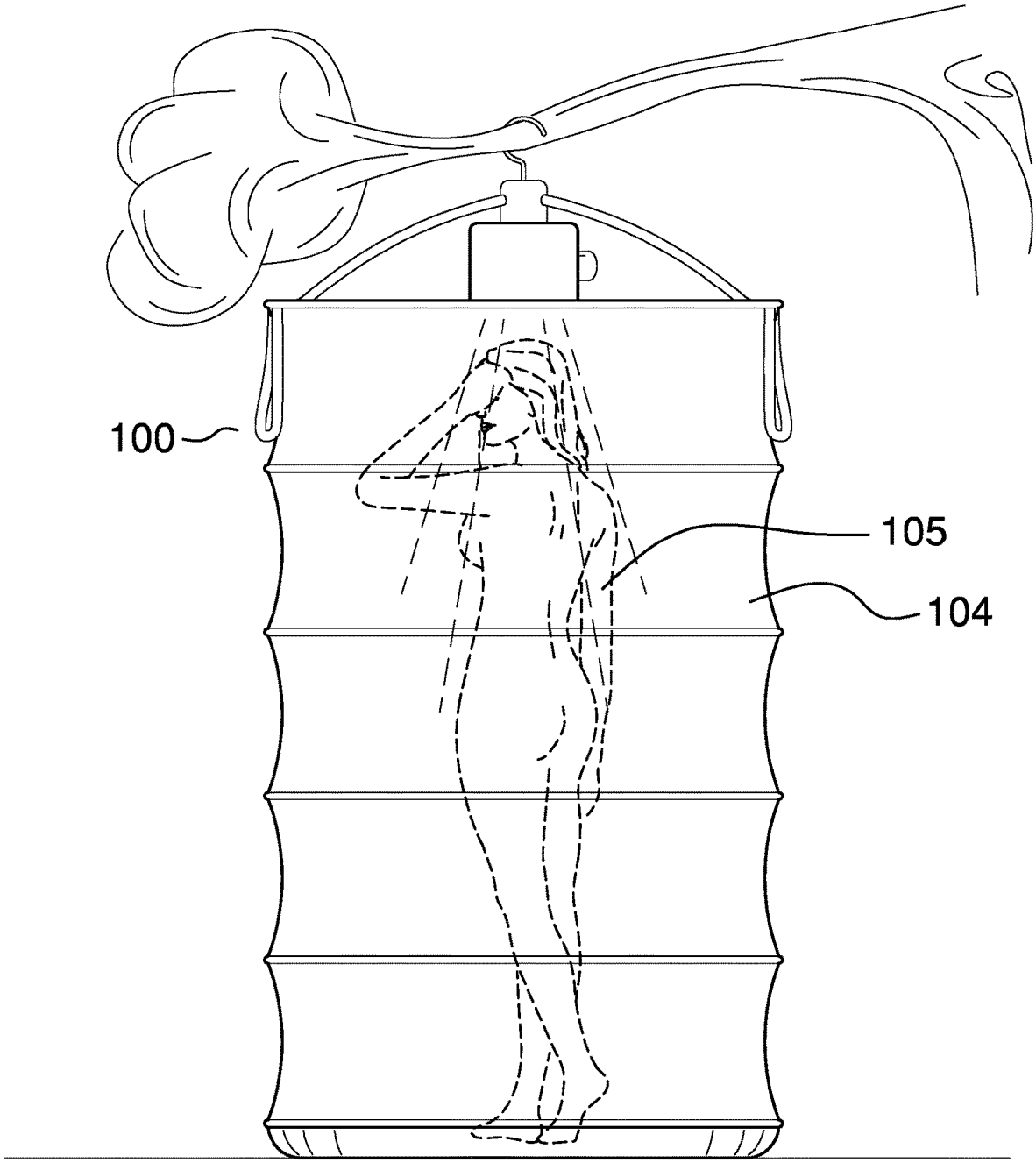
FIG. 4 is an in-use view of an embodiment of the disclosure.
Figure 5:
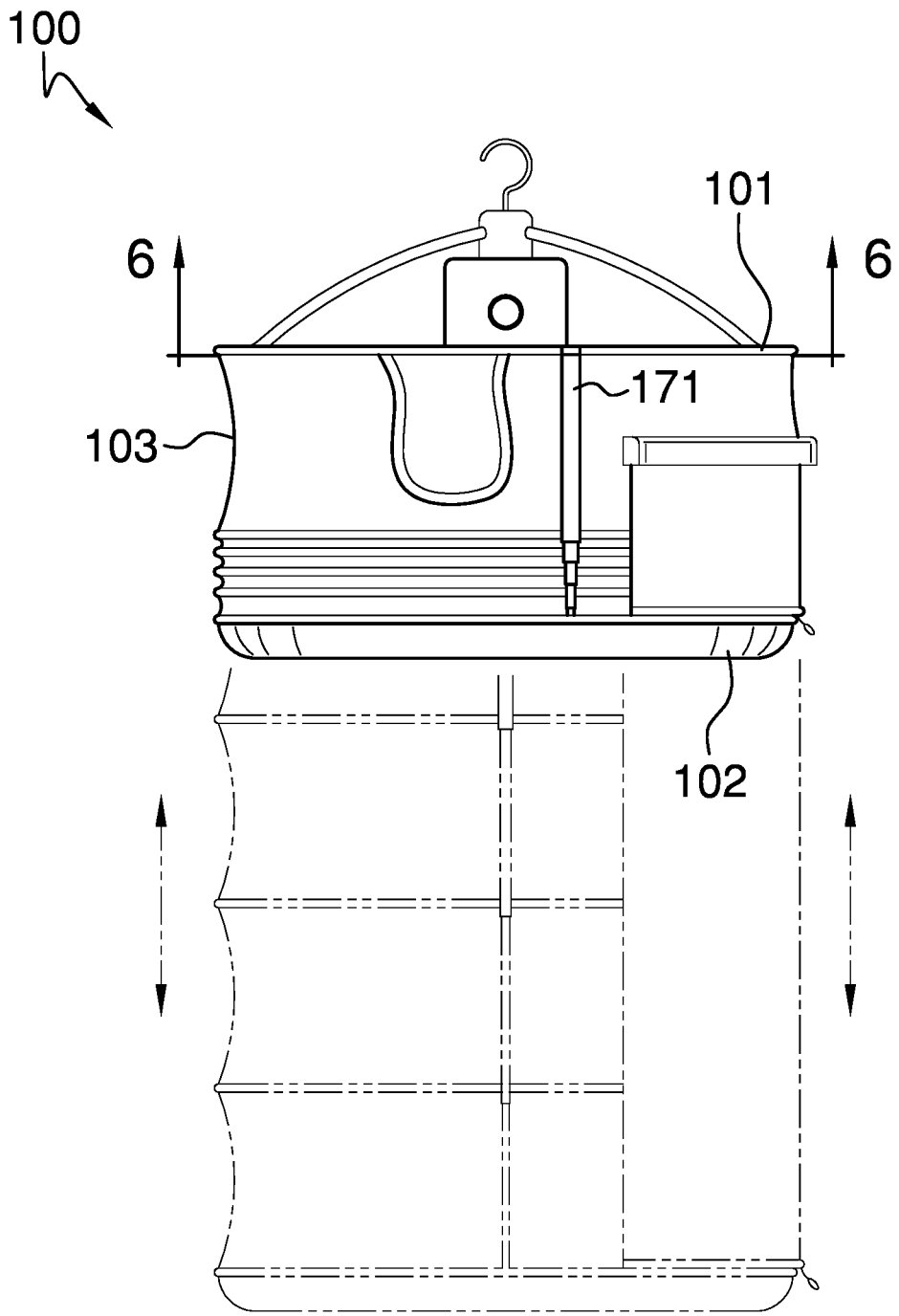
FIG. 5 is a side view of an embodiment of the disclosure.
Figure 6:
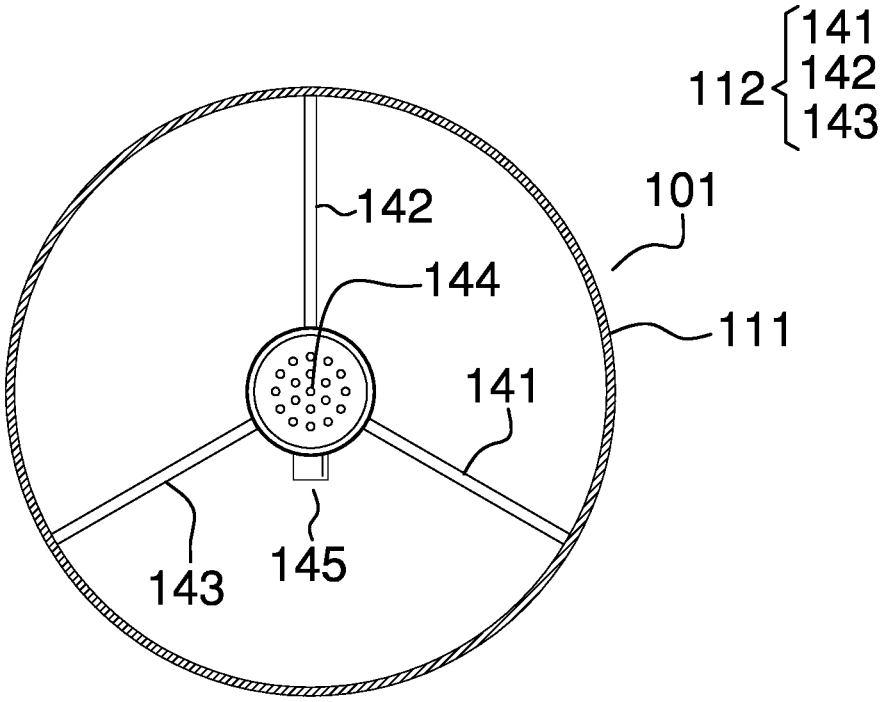
FIG. 6 is a bottom view of an embodiment of the disclosure.
Figure 7:
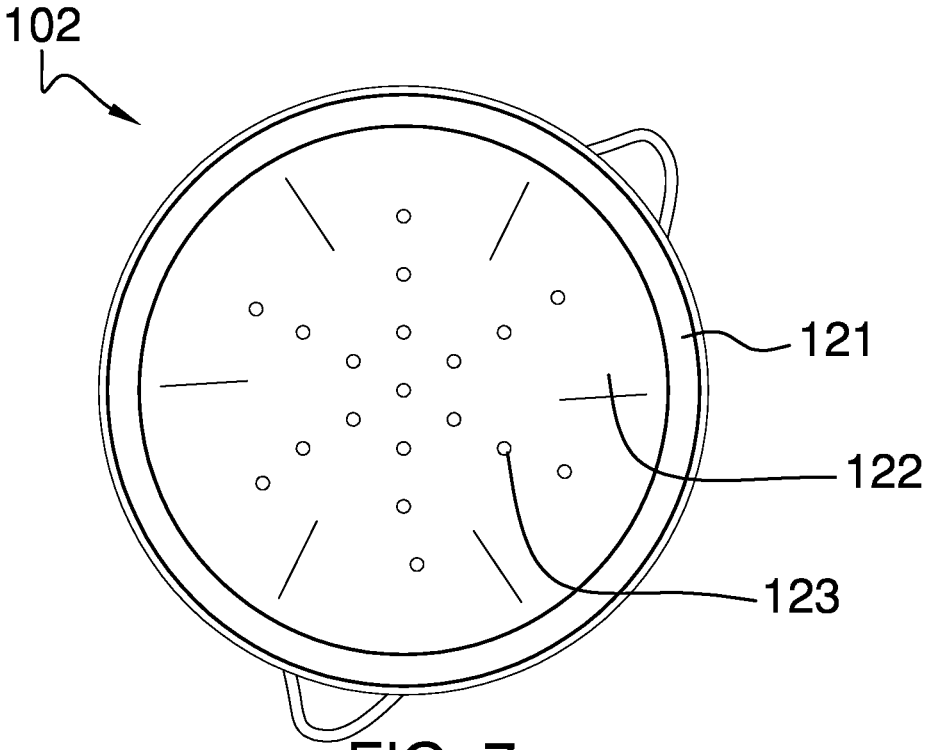
FIG. 7 is a detail view of an embodiment of the disclosure.

Detailed reference will now be made to one or more potential embodiments of the disclosure, which are illustrated in FIGS. 1 through 7.

The collapsible outdoor shower 100 (hereinafter invention) is a temporary structure. The invention 100 is a collapsible structure. The invention 100 is configured for outdoor use. The invention 100 is deployed to create a private space 104 for a client 105 that is used for showering. The invention 100 comprises a superior structure 101, a capture pan 102, and a lateral bracing structure 103. The lateral bracing structure 103 secures the capture pan 102 to the superior structure 101. The superior structure 101 suspends the invention 100 from an externally provisioned structure. The lateral bracing structure 103 forms the private space 104 that encloses the client 105. The capture pan 102 forms a protected surface on which the client 105 stands while in the private space 104. The private space 104 is defined elsewhere in this disclosure. The client 105 is defined elsewhere in this disclosure.

The superior structure 101 is a mechanical structure. The superior structure 101 forms the superior structure 101 of the invention 100 when the invention 100 is deployed. The superior structure 101 suspends the invention 100 from an externally provisioned structure. The superior structure 101 receives water under pressure from an externally provisioned source of water and discharges the received water as a spray into the private space 104 formed by the invention 100. The superior structure 101 comprises a superior ring 111, a plurality of spokes 112, a hub 113, a hook 114, a shower head 115, and a plurality of handles 116.

The superior ring 111 is a ring shaped structure. The superior ring 111 is a rigid structure. The superior ring 111 forms an open congruent end of the prism-shaped structure formed by the lateral bracing 103. The superior ring 111 attaches the superior structure 101 to the lateral bracing 103. The plurality of handles 116 attach to the superior ring 111.

The hub 113 is a mechanical structure. The hub 113 is positioned at the center of the ring structure of the superior ring 111 such that the center of the hub 113 and the center of the superior ring 111 form a line that is aligned with the vertical direction. The hub 113 contains the shower head 115. The hook 114 attaches to the superior surface of the hub 113.

Each of the plurality of spokes 112 is a prism-shaped structure. The plurality of spokes 112 physically secures the hub 113 to the superior ring 111 such that the hub 113 is at the center of the superior ring 111. The plurality of spokes 112 transfers the loads of the superior ring 111, the capture pan 102, and the lateral bracing 103 to the hub 113 when the invention 100 is suspended for deployment. The relative positions of each of the plurality of spokes 112 is such that the angle between any two adjacent spokes selected from the plurality of spokes 112 is equal. The plurality of spokes 112 further comprises a first spoke 141, a second spoke 142, and a third spoke 143.

The first spoke 141 is a first prism structure selected from the plurality of spokes 112 that attaches the superior ring 111 to the hub 113. The second spoke 142 is a second prism structure selected from the plurality of spokes 112 that attaches the superior ring 111 to the hub 113. The third spoke 143 is a third prism structure selected from the plurality of spokes 112 that attaches the superior ring 111 to the hub 113.

The hook 114 is a mechanical structure. The hook 114 suspends the hub 113 from the externally provisioned structure.

The shower head 115 is a nozzle structure. The shower head 115 receives water under pressure from an externally provisioned source of water and discharges the received water as a spray into the private space 104 of the invention 100. The shower head 115 mounts in the interior space of the hub 113 such that the hub 113 forms a protective shell around the shower head 115. The shower head 115 further comprises a spray nozzle 144 and a fitting 145.

The spray nozzle 144 is a mechanical structure that receives water under pressure from the fitting 145 and discharges the water as a spray into the private space 104 of the invention 100. The fitting 145 is a mechanical structure that forms a fluidic connection between the spray nozzle 144 and the water under pressure from an externally provisioned source of water. The spray nozzle 144 and the fitting 145 are defined elsewhere in this disclosure.

Each of the plurality of handles 116 is a grip that attaches to the superior ring 111. Each of the plurality of handles 116 allows for both carrying and manipulating the invention 100.

The capture pan 102 is a mechanical structure. The capture pan 102 forms the capture pan 102 of the invention 100 when the invention 100 is deployed. The capture pan 102 forms a physical barrier that allows the client 105. The capture pan 102 drains the water that falls on the capture pan 102 out of the private space 104 formed by the invention 100. The capture pan 102 comprises an inferior ring 121 and an inferior pan 122.

The inferior ring 121 is a ring shaped structure. The inferior ring 121 is a rigid structure. The inferior ring 121 forms an open congruent end of the prism-shaped structure formed by the lateral bracing 103. The inferior ring 121 attaches the capture pan 102 to the lateral bracing 103.

The inferior pan 122 is a mechanical structure. The inferior pan 122 is selected from the group consisting of a rigid structure and a sheeting. The inferior pan 122 is geometrically similar to the characteristic aperture formed by the ring structure of the inferior ring 121. The inferior pan 122 attaches to the inferior ring 121 such that the inferior pan 122 encloses the open congruent end of the prism structure of the lateral bracing 103. The inferior pan 122 of the capture pan 102 causes the superior structure 101, the capture pan 102, and the lateral bracing 103 to form a pan shaped structure. The inferior pan 122 forms the physical barrier between the client 105 and the ground. The inferior pan 122 further comprises one or more scuppers 123. Each of the one or more scuppers 123 is an aperture formed through the inferior pan 122 such that water that accumulates in the inferior pan 122 drains out of the inferior pan 122 through the one or more scuppers 123.

The lateral bracing 103 is a mechanical structure. The lateral bracing 103 forms a prism-shaped structure. The lateral bracing 103 is a collapsible structure. By collapsible is meant that the span of the length of the center axis of the prism structure formed by the lateral bracing 103 is adjustable. The lateral bracing 103 forms a vertical barrier that creates the private space 104 of the invention 100. The lateral bracing 103 forms an openwork framework that is enclosed by a sheeting structure. The open framework of the lateral bracing 103 forms the prism-shaped structure of the lateral bracing 103. The open framework of the lateral bracing 103 forms the collapsible elements of the lateral bracing 103. The sheeting of the bracing 103 that encloses the openwork framework is a flexible structure.

The sheeting of the bracing 103 is a hydrophobic structure. The sheeting structure is a mildew resistance structure. The mildew resistance of the sheeting structure is derived by treating the sheeting structure with 5-chloro-2-(2,4-dichlorophenoxy)-phenol (CAS 3380-34-5). The sheeting of the bracing 103 is an opaque structure. The sheeting of the bracing 103 forms the vertically oriented barriers that form the private space 104 of the invention 100. The sheeting of the bracing 103 is a flexible structure that folds as the openwork framework is collapsed.

The lateral bracing 103 comprises a privacy sheeting 131, a privacy curtain 132, a plurality of c-rings 133, a plurality of telescopic stanchions 134, a curtain sheeting 135, and a curtain rod 136.

Each of the plurality of c-rings 133 is a c-ring shaped structure. Each of the plurality of c-rings 133 is a rigid structure. Each of the plurality of c-rings 133 is identical. Each of the plurality of c-rings 133 mount in the lateral bracing 103 such that the center of each of the plurality of c-rings 133 are aligned. The line formed by the centers of each of the plurality of c-rings 133 forms the center axis of the prism structure formed by the lateral bracing 103. Each of the plurality of c-rings 133 attaches to the privacy sheeting 131 such that the privacy sheeting 131 forms a vertically oriented barrier around the private space 104 of the invention 100. Each of the open sections of the c structure of each of the plurality of c-rings 133 are aligned such that the open spaces combine to form an entryway into the private space 104 of the invention 100.

The plurality of c-rings 133 comprises a first c-ring 161, a second c-ring 162, a third c-ring 163, and a fourth c-ring 164. The first c-ring 161 is the c-ring selected from the plurality of c-rings 133 that is proximal to the superior ring 111. The fourth c-ring 164 is the c-ring selected from the plurality of c-rings 133 that is proximal to the inferior ring 121. The second c-ring 162 is the c-ring selected from the plurality of c-rings 133 that is between the first c-ring 161 and the third c-ring 163. The third c-ring 163 is the c-ring selected from the plurality of c-rings 133 that is between the second c-ring 162 and the fourth c-ring 164.

The privacy sheeting 131 is a textile. Each of the plurality of c-rings 133 is secured to the privacy sheeting 131. The privacy sheeting 131 forms a portion of the sheeting structure that forms the private space 104. The privacy curtain 132 encloses the portion of the privacy space 104 that is defined by the plurality of c-rings 133. The privacy sheeting 131 comprises a first rouleau 151, a second rouleau 152, a third rouleau 153, a fourth rouleau 154, a fifth rouleau 155, and a sixth rouleau 156.

The first rouleau 151 is a rouleau that is formed along the perimeter of the textile structure of the privacy sheeting 131. The superior ring 111 inserts into the first rouleau 151 to secure the superior structure 101 to the privacy sheeting 131. The sixth rouleau 156 is a rouleau that is formed on the perimeter of the privacy sheeting 131 that is distal from the first rouleau 151. The inferior ring 121 inserts into the sixth rouleau 156 to secure the inferior ring 121 to the privacy sheeting 131.

The second rouleau 152 is a rouleau that is formed on the face of the privacy sheeting 131. The first c-ring 161 inserts into the second rouleau 152 to secure the first c-ring 161 to the privacy sheeting 131. The third rouleau 153 is a rouleau that is formed on the face of the privacy sheeting 131. The second c-ring 162 inserts into the third rouleau 153 to secure the second c-ring 162 to the privacy sheeting 131. The fourth rouleau 154 is a rouleau that is formed on the face of the privacy sheeting 131. The third c-ring 163 inserts into the fourth rouleau 154 to secure the third c-ring 163 to the privacy sheeting 131. The fifth rouleau 155 is a rouleau that is formed on the face of the privacy sheeting 131. The fourth c-ring 164 inserts into the fifth rouleau 155 to secure the fourth c-ring 164 to the privacy sheeting 131.

The privacy curtain 132 is a textile. The privacy curtain 132 attaches to the superior ring 111 of the superior structure 101. The privacy curtain 132 encloses the opening in the private space 104 that is formed by the plurality of c-rings 133. The privacy curtain 132 further comprises a curtain sheeting 135 and a curtain rod 136.

The curtain sheeting 135 is a textile panel. The curtain sheeting 135 encloses the opening formed by the plurality of c-rings 133 after the client 105 has entered the private space 104. The curtain rod 136 is a mechanical structure that suspends the curtain sheeting 135 to the superior ring 111 of the superior structure 101. The curtain rod 136 attaches to the curtain sheeting 135 to the superior ring 111 such that the curtain sheeting 135 will slide along the superior ring 111.

Each of the plurality of telescopic stanchions 134 is a stanchion that secures the plurality of c-rings 133, the superior ring 111, and the inferior ring 121 to each other. Each of the plurality of telescopic stanchions 134 is a composite prism structure. Each of the plurality of telescopic stanchions 134 is a telescopic structure such that the span of the length of the center axis of each of the plurality of telescopic stanchions 134 is adjustable.

The span of the distance between the superior ring 111 and the plurality of c-rings 133 adjusts by adjusting the span of the length of the center axis of each of the plurality of telescopic stanchions 134. The span of the distance between the inferior ring 121 and the plurality of c-rings 133 adjusts by adjusting the span of the length of the center axis of each of the plurality of telescopic stanchions 134. The span of the distance between any two adjacent c-rings selected from the plurality of c-rings 133 adjusts by adjusting the span of the length of the center axis of each of the plurality of telescopic stanchions 134.

The plurality of telescopic stanchions 134 comprises a first telescopic stanchion 171 and a second telescopic stanchion 172.

The first telescopic stanchion 171 is a telescopic structure that comprises a first arm 181, a second arm 182, and a first detent 191. The first detent 191 is a mechanical device that locks and secures the first arm 181 to the second arm 182. The first arm 181 is a hollow prism that is further defined with an inner dimension. The second arm 182 is a hollow prism that is further defined with an outer dimension. The second arm 182 is geometrically similar to the first arm 181. The span of the outer dimension of the second arm 182 is lesser than the span of the inner dimension of the first arm 181 such that the second arm 182 inserts into the first arm 181 in a telescopic fashion to form a composite prism structure.

The span of the length of the first telescopic stanchion 171 adjusts by adjusting the relative position of the second arm 182 within the first arm 181. The position of the second arm 182 relative to the first arm 181 is held in position using the first detent 191. The first detent 191 is selected from the group consisting of a cotter pin, a G snap collar, a cam lock collar, a threaded clutch, a split collar lock, and a spring loaded ball lock.

The first telescopic stanchion 171 further comprises a third arm 183 and a second detent 192. The second detent 192 is a mechanical device that locks and secures the third arm 183 to the second arm 182. The second arm 182 is further defined with an inner dimension. The third arm 183 is a hollow prism that is further defined with an outer dimension. The third arm 183 is geometrically similar to the second arm 182. The span of the outer dimension of the third arm 183 is lesser than the span of the inner dimension of the second arm 182 such that the third arm 183 inserts into the second arm 182 in a telescopic fashion to form a composite prism structure.

The span of the length of the first telescopic stanchion 171 adjusts by adjusting the relative position of the third arm 183 within the second arm 182. The position of the third arm 183 relative to the second arm 182 is held in position using the second detent 192. The second detent 192 is selected from the group consisting of a cotter pin, a G snap collar, a cam lock collar, a threaded clutch, a split collar lock, and a spring loaded ball lock.

The first telescopic stanchion 171 further comprises a fourth arm 184 and a third detent 193. The third detent 193 is a mechanical device that locks and secures the fourth arm 184 to the third arm 183. The third arm 183 is further defined with an inner dimension. The fourth arm 184 is a hollow prism that is further defined with an outer dimension. The fourth arm 184 is geometrically similar to the third arm 183. The span of the outer dimension of the fourth arm 184 is lesser than the span of the inner dimension of the third arm 183 such that the fourth arm 184 inserts into the third arm 183 in a telescopic fashion to form a composite prism structure.

The span of the length of the first telescopic stanchion 171 adjusts by adjusting the relative position of the fourth arm 184 within the third arm 183. The position of the fourth arm 184 relative to the third arm 183 is held in position using the third detent 193. The third detent 193 is selected from the group consisting of a cotter pin, a G snap collar, a cam lock collar, a threaded clutch, a split collar lock, and a spring loaded ball lock.

The first telescopic stanchion 171 further comprises a fifth arm 185 and a fourth detent 194. The fourth detent 194 is a mechanical device that locks and secures the fifth arm 185 to the fourth arm 184. The fourth arm 184 is further defined with an inner dimension. The fifth arm 185 is a hollow prism that is further defined with an outer dimension. The fifth arm 185 is geometrically similar to the fourth arm 184. The span of the outer dimension of the fifth arm 185 is lesser than the span of the inner dimension of the fourth arm 184 such that the fifth arm 185 inserts into the fourth arm 184 in a telescopic fashion to form a composite prism structure.

The span of the length of the first telescopic stanchion 171 adjusts by adjusting the relative position of the fifth arm 185 within the fourth arm 184. The position of the fifth arm 185 relative to the fourth arm 184 is held in position using the fourth detent 194. The fourth detent 194 is selected from the group consisting of a cotter pin, a G snap collar, a cam lock collar, a threaded clutch, a split collar lock, and a spring loaded ball lock.

The second telescopic stanchion 172 is a telescopic structure that comprises a sixth arm 186, a seventh arm 187, and a fifth detent 195. The fifth detent 195 is a mechanical device that locks and secures the sixth arm 186 to the seventh arm 187. The sixth arm 186 is a hollow prism that is further defined with an inner dimension. The seventh arm 187 is a hollow prism that is further defined with an outer dimension. The seventh arm 187 is geometrically similar to the sixth arm 186. The span of the outer dimension of the seventh arm 187 is lesser than the span of the inner dimension of the sixth arm 186 such that the seventh arm 187 inserts into the sixth arm 186 in a telescopic fashion to form a composite prism structure.

The span of the length of the second telescopic stanchion 172 adjusts by adjusting the relative position of the seventh arm 187 within the sixth arm 186. The position of the seventh arm 187 relative to the sixth arm 186 is held in position using the fifth detent 195. The fifth detent 195 is selected from the group consisting of a cotter pin, a G snap collar, a cam lock collar, a threaded clutch, a split collar lock, and a spring loaded ball lock.

The second telescopic stanchion 172 further comprises an eighth arm 188 and a sixth detent 196. The sixth detent 196 is a mechanical device that locks and secures the eighth arm 188 to the seventh arm 187. The seventh arm 187 is further defined with an inner dimension. The eighth arm 188 is a hollow prism that is further defined with an outer dimension. The eighth arm 188 is geometrically similar to the seventh arm 187. The span of the outer dimension of the eighth arm 188 is lesser than the span of the inner dimension of the seventh arm 187 such that the eighth arm 188 inserts into the seventh arm 187 in a telescopic fashion to form a composite prism structure.

The span of the length of the second telescopic stanchion 172 adjusts by adjusting the relative position of the eighth arm 188 within the seventh arm 187. The position of the eighth arm 188 relative to the seventh arm 187 is held in position using the sixth detent 196. The sixth detent 196 is selected from the group consisting of a cotter pin, a G snap collar, a cam lock collar, a threaded clutch, a split collar lock, and a spring loaded ball lock.

The second telescopic stanchion 172 further comprises a ninth arm 189 and a seventh detent 197. The seventh detent 197 is a mechanical device that locks and secures the ninth arm 189 to the eighth arm 188. The eighth arm 188 is further defined with an inner dimension. The ninth arm 189 is a hollow prism that is further defined with an outer dimension. The ninth arm 189 is geometrically similar to the eighth arm 188. The span of the outer dimension of the ninth arm 189 is lesser than the span of the inner dimension of the eighth arm 188 such that the ninth arm 189 inserts into the eighth arm 188 in a telescopic fashion to form a composite prism structure.

The span of the length of the second telescopic stanchion 172 adjusts by adjusting the relative position of the ninth arm 189 within the eighth arm 188. The position of the ninth arm 189 relative to the eighth arm 188 is held in position using the seventh detent 197. The seventh detent 197 is selected from the group consisting of a cotter pin, a G snap collar, a cam lock collar, a threaded clutch, a split collar lock, and a spring loaded ball lock.

The second telescopic stanchion 172 further comprises a tenth arm 190 and an eighth detent 198. The eighth detent 198 is a mechanical device that locks and secures the tenth arm 190 to the ninth arm 189. The ninth arm 189 is further defined with an inner dimension. The tenth arm 190 is a hollow prism that is further defined with an outer dimension. The tenth arm 190 is geometrically similar to the ninth arm 189. The span of the outer dimension of the tenth arm 190 is lesser than the span of the inner dimension of the ninth arm 189 such that the tenth arm 190 inserts into the ninth arm 189 in a telescopic fashion to form a composite prism structure.

The span of the length of the second telescopic stanchion 172 adjusts by adjusting the relative position of the tenth arm 190 within the ninth arm 189. The position of the tenth arm 190 relative to the ninth arm 189 is held in position using the eighth detent 198. The eighth detent 198 is selected from the group consisting of a cotter pin, a G snap collar, a cam lock collar, a threaded clutch, a split collar lock, and a spring loaded ball lock.

The first arm 181 rigidly attaches to both the superior ring 111 and the first c-ring 161. The second arm 182 rigidly attaches to both the second c-ring 162 while simultaneously inserting into the first arm 181. The third arm 183 rigidly attaches to both the third c-ring 163 while simultaneously inserting into the second arm 182. The fourth arm 184 rigidly attaches to both the fourth c-ring 164 while simultaneously inserting into the third arm 183. The fifth arm 185 rigidly attaches to both the inferior ring 121 while simultaneously inserting into the fourth arm 184.

The sixth arm 186 rigidly attaches to both the superior ring 111 and the first c-ring 161. The seventh arm 187 rigidly attaches to both the second c-ring 162 while simultaneously inserting into the sixth arm 186. The eighth arm 188 rigidly attaches to both the third c-ring 163 while simultaneously inserting into the seventh arm 187. The ninth arm 189 rigidly attaches to both the fourth c-ring 164 while simultaneously inserting into the eighth arm 188. The tenth arm 190 rigidly attaches to both the inferior ring 121 while simultaneously inserting into the ninth arm 189.

The following definitions were used in this disclosure:

5-chloro-2-(2,4-dichlorophenoxy)-phenol: As used in this disclosure, 5-chloro-2-(2,4-dichlorophenoxy)-phenol (CAS 3380 34-5) is an antifungal and antibiotic agent that is commonly used in consumer products. 5-chloro-2-(2,4-dichlorophenoxy)-phenol is commonly referred to as triclosan.

Align: As used in this disclosure, align refers to an arrangement of objects that are: 1) arranged in a straight plane or line; 2) arranged to give a directional sense of a plurality of parallel planes or lines; or, 3) a first line or curve is congruent to and overlaid on a second line or curve.

C-Ring: As used in this disclosure, a C-Ring refers to a non-Euclidean prism structure that is formed with a shape characteristic of the letter C.

Center: As used in this disclosure, a center is a point that is: 1) the point within a circle that is equidistant from all the points of the circumference; 2) the point within a regular polygon that is equidistant from all the vertices of the regular polygon; 3) the point on a line that is equidistant from the ends of the line; 4) the point, pivot, or axis around which something revolves; or, 5) the centroid or first moment of an area or structure. In cases where the appropriate definition or definitions are not obvious, the fifth option should be used in interpreting the specification.

Center Axis: As used in this disclosure, the center axis is the axis of a cylinder or a prism. The center axis of a prism is the line that joins the center point of the first congruent face of the prism to the center point of the second corresponding congruent face of the prism. The center axis of a pyramid refers to a line formed through the apex of the pyramid that is perpendicular to the base of the pyramid. When the center axes of two cylinder, prism or pyramidal structures share the same line they are said to be aligned. When the center axes of two cylinder, prism or pyramidal structures do not share the same line they are said to be offset.

Client: As used in this disclosure, a client is an individual who is designated to receive the services of the disclosure at bar.

Collapsible: As used in this disclosure, the terms collapsible refers to an object that is configured such that the volume of the object is adjustable. By volume is meant the volume of the perimetrical boundary that contains the object. The verb collapse means that the volume of the object is adjusted from a larger volume to a smaller volume. The verbs expand and deploy mean that the volume of the object is adjusted from a smaller volume to a larger volume.

Congruent: As used in this disclosure, congruent is a term that compares a first object to a second object. Specifically, two objects are said to be congruent when: 1) they are geometrically similar; and, 2) the first object can superimpose over the second object such that the first object aligns, within manufacturing tolerances, with the second object.

Correspond: As used in this disclosure, the term correspond is used as a comparison between two or more objects wherein one or more properties shared by the two or more objects match, agree, or align within acceptable manufacturing tolerances.

Disk: As used in this disclosure, a disk is a prism-shaped object that is flat in appearance. The disk is formed from two congruent ends that are attached by a lateral face. The sum of the surface areas of two congruent ends of the prism-shaped object that forms the disk is greater than the surface area of the lateral face of the prism-shaped object that forms the disk. In this disclosure, the congruent ends of the prism-shaped structure that forms the disk are referred to as the faces of the disk.

Fitting: As used in this disclosure, a fitting is a component that is attached to a first object. The fitting is used to forming a fluidic connection between the first object and a second object.

Fluid: As used in this disclosure, a fluid refers to a state of matter wherein the matter is capable of flow and takes the shape of a container it is placed within. The term fluid commonly refers to a liquid or a gas.

Fluidic Connection: As used in this disclosure, a fluidic connection refers to a tubular structure that transports a fluid from a first object to a second object. Methods to design and use a fluidic connections are well-known and documented in the mechanical, chemical, and plumbing arts.

Force: As used in this disclosure, a force refers to a net (or unopposed) measurable interaction that changes the direction of motion of an object, the velocity of motion of an object, the momentum of an object, or the stress within an object.

Force of Gravity: As used in this disclosure, the force of gravity refers to a vector that indicates the direction of the pull of gravity on an object at or near the surface of the earth.

Form Factor: As used in this disclosure, the term form factor refers to the size and shape of an object.

Framework: As used in this disclosure, a framework refers to the substructure of an object that forms the load path for the object.

Geometrically Similar: As used in this disclosure, geometrically similar is a term that compares a first object to a second object wherein: 1) the sides of the first object have a one to one correspondence to the sides of the second object; 2) wherein the ratio of the length of each pair of corresponding sides are equal; 3) the angles formed by the first object have a one to one correspondence to the angles of the second object; and, 4) wherein the corresponding angles are equal. The term geometrically identical refers to a situation where the ratio of the length of each pair of corresponding sides equals 1.

GHT: As used in this disclosure, GHT refers to a standard Garden Hose Thread. The GHT is a threaded connection standard that is used in the United States for attaching a garden hose to a water supply for attaching one of a plurality of attachments to the garden hose.

Grip: As used in this disclosure, a grip is an accommodation formed on or within an object that allows the object to be grasped or manipulated by a hand.

Ground: As used in this disclosure, the ground is a solid supporting surface formed by the Earth. The term level ground means that the supporting surface formed by the ground is roughly perpendicular to the force of gravity. Always use supporting surface.

Handle: As used in this disclosure, a handle is an object by which a tool, object, or door is held or manipulated with the hand.

Hook: As used in this disclosure, a hook is an object that is curved or bent at an angle such that items can be hung on or caught by the object.

Horizontal: As used in this disclosure, horizontal is a directional term that refers to a direction that is either: 1) parallel to the horizon; 2) perpendicular to the local force of gravity, or, 3) parallel to a supporting surface. In cases where the appropriate definition or definitions are not obvious, the second option should be used in interpreting the specification. Unless specifically noted in this disclosure, the horizontal direction is always perpendicular to the vertical direction.

Hose: As used in this disclosure, a hose is a flexible hollow tube that is used for transporting liquids and gases. When referring to a hose in this disclosure, the terms inner diameter and outer diameter are used as they would be used by those skilled in the plumbing arts.

Hydrophobic: As used in this disclosure, hydrophobic refers to a substance that repels and does not mix with water. Hydrophobic materials are often selected because they will not absorb water.

Inferior: As used in this disclosure, the term inferior refers to a directional reference that is parallel to and in the same direction as the force of gravity when an object is positioned or used normally.

Liquid: As used in this disclosure, a liquid refers to a state (phase) of matter that is fluid and that maintains, for a given pressure, a fixed volume that is independent of the volume of the container.

Load: As used in this disclosure, the term load refers to an object upon which a force is acting or which is otherwise absorbing energy in some fashion. Examples of a load in this sense include, but are not limited to, a mass that is being moved a distance or an electrical circuit element that draws energy. The term load is also commonly used to refer to the forces that are applied to a stationary structure.

Load Path: As used in this disclosure, a load path refers to a chain of one or more structures that transfers a load generated by a raised structure or object to a foundation, supporting surface, or the earth.

Loop: As used in this disclosure, a loop is the length of a first linear structure including, but not limited to, shafts, lines, cords, or webbings, that is: 1) folded over and joined at the ends forming an enclosed space; or, 2) curved to form a closed or nearly closed space within the first linear structure. In both cases, the space formed within the first linear structure is such that a second linear structure such as a line, cord or a hook can be inserted through the space formed within the first linear structure. Within this disclosure, the first linear structure is said to be looped around the second linear structure.

Negative Space: As used in this disclosure, negative space is a method of defining an object through the use of open or empty space as the definition of the object itself, or, through the use of open or empty space to describe the boundaries of an object.

Non-Euclidean Prism: As used in this disclosure, a non-Euclidean prism is a prism structure wherein the center axis of the prism lies on a non-Euclidean plane or is otherwise formed with a curvature.

Non-Euclidean Structure: As used in this disclosure, a non-Euclidean structure is a structure wherein an axis of the structure lies on a non-Euclidean plane or is otherwise formed with a curvature.

Nozzle: As used in this disclosure, a nozzle is a device that receives fluid under pressure and releases the fluid in a controlled manner into an environment.

One to One: When used in this disclosure, a one to one relationship means that a first element selected from a first set is in some manner connected to only one element of a second set. A one to one correspondence means that the one to one relationship exists both from the first set to the second set and from the second set to the first set. A one to one fashion means that the one to one relationship exists in only one direction.

Openwork: As used in this disclosure, the term open work is used to describe a structure, often a surface, which is formed with one or more openings that allow for visibility and fluid flow through the structure. Wrought work and meshes are forms of openwork.

Pan: As used in this disclosure, a pan is a hollow and prism-shaped containment structure. The pan has a single open face. The open face of the pan is often, but not always, the superior face of the pan. The open face is a surface selected from the group consisting of: a) a congruent end of the prism structure that forms the pan; and, b) a lateral face of the prism structure that forms the pan. A semi-enclosed pan refers to a pan wherein the closed end of prism structure of the pan and/or a portion of the closed lateral faces of the pan is are open.

Perimeter: As used in this disclosure, a perimeter is one or more curved or straight lines that bounds an enclosed area on a plane or surface. The perimeter of a circle is commonly referred to as a circumference.

Permanent: As used in this disclosure, the term permanent refers to a fundamental state, condition, or location of an object, process, or arrangement that is not subject to, or expected to be, changed. A perpetual object refers to a permanent object that is expected to last over an unlimited period of time. A building such as a house or a skyscraper would be considered permanent. An ocean would be considered perpetual.

PET: As used in this disclosure, PET is an acronym for poly(ethylene terephthalate) (CAS 25038-59-9) which is the base chemical used in the formation of polyester yarn.

Pressure: As used in this disclosure, pressure refers to a measure of force per unit area.

Prism: As used in this disclosure, a prism is a three-dimensional geometric structure wherein: 1) the form factor of two faces of the prism are congruent; and, 2) the two congruent faces are parallel to each other. The two congruent faces are also commonly referred to as the ends of the prism. The surfaces that connect the two congruent faces are called the lateral faces. In this disclosure, when further description is required a prism will be named for the geometric or descriptive name of the form factor of the two congruent faces. If the form factor of the two corresponding faces has no clearly established or well-known geometric or descriptive name, the term irregular prism will be used. The center axis of a prism is defined as a line that joins the center point of the first congruent face of the prism to the center point of the second corresponding congruent face of the prism. The center axis of a prism is otherwise analogous to the center axis of a cylinder. A prism wherein the ends are circles is commonly referred to as a cylinder.

Private: As used in this disclosure, the term private refers to the limitation of use of an object to one or more individual. The term privacy refers to maintaining an object or individual in a location where the object or individual can be neither observed nor disturbed.

Rigid Structure: As used in this disclosure, a rigid structure is a solid structure formed from an inelastic material that resists changes in shape. A rigid structure will permanently deform as it fails under a force. See bimodal flexible structure.

Ring: As used in this disclosure, a ring is term that is used to describe a disk-like structure through which an aperture is formed. Rings are often considered loops.

Rouleau: As used in this disclosure, a rouleau is a tube or channel that is formed on a textile or sheeting.

Scupper: As used in this disclosure, a scupper is an aperture that allows a liquid to drain away from a contained space or deck.

Sheeting: As used in this disclosure, a sheeting is a material, such as a paper, textile, a plastic, or a metal foil, in the form of a thin flexible layer or layers. The sheeting forms a disk structure. The two surfaces of the sheeting with the greatest surface area are called the faces of the sheeting.

Shower: As used in this disclosure, a shower is a mechanical structure that generates a spray of water used by a client for cleaning. The shower is typically maintained in an enclosed space that provides privacy. A community shower refers to one or more showers that do not provide for the privacy of the client.

Spoke: As used in this disclosure, a spoke refers to one of a plurality of prism-shaped shaft structures that project radially away from a center point of a central hub. Spokes are often rotated around the center point by the rotation of the central hub.

Spray: As used in this disclosure, a spray is a plurality of liquid drops dispersed in a gas.

Spray Nozzle: As used in this disclosure, a spray nozzle is a device that receives liquid under pressure and disperses that liquid into the atmosphere as a spray.

Superior: As used in this disclosure, the term superior refers to a directional reference that is parallel to and in the opposite direction of the force of gravity when an object is positioned or used normally.

Supporting Surface: As used in this disclosure, a supporting surface is a horizontal surface upon which an object is placed and to which the load of the object is transferred. This disclosure assumes that an object placed on the supporting surface is in an orientation that is appropriate for the normal or anticipated use of the object.

Suspend: As used in this disclosure, to suspend an object means to support an object such that the inferior end of the object does not form a significant portion of the load path of the object.

Telescopic: As used in this disclosure, telescopic is an adjective that describes a composite prism structure made of hollow prism-shaped sections that fit or slide into each other such that the composite prism structure can be made longer or shorter by adjusting the relative positions of the hollow prism-shaped sections.

Temporary: As used in this disclosure, the term temporary refers to a state, condition, or location of an object, process, or arrangement that is intended to last for a limited period of time. The term temporary is the opposite of permanent. The term transient refers to a temporary state or condition of an object that degrades over time. In physical processes, the term transient tends to imply a short period of time.

Textile: As used in this disclosure, a textile is a material that is woven, knitted, braided or felted. Synonyms in common usage for this definition include fabric and cloth. The two surfaces of the textile with the greatest surface area are called the faces of the textile.

Tube: As used in this disclosure, a tube is a hollow prism-shaped device formed with two open congruent ends. The tube is used for transporting liquids (including bulk solids) and gases. The line that connects the center of the first congruent face of the prism to the center of the second congruent face of the prism is referred to as the center axis of the tube or the centerline of the tube. When two tubes share the same centerline they are said to be aligned. When the centerlines of two tubes are perpendicular to each other, the tubes are said to be perpendicular to each other. In this disclosure, the terms inner dimensions of a tube and outer dimensions of a tube are used as they would be used by those skilled in the plumbing arts.

Vertical: As used in this disclosure, vertical refers to a direction that is either: 1) perpendicular to the horizontal direction; 2) parallel to the local force of gravity; or, 3) when referring to an individual object the direction from the designated top of the individual object to the designated bottom of the individual object. In cases where the appropriate definition or definitions are not obvious, the second option should be used in interpreting the specification. Unless specifically noted in this disclosure, the vertical direction is always perpendicular to the horizontal direction.

With respect to the above description, it is to be realized that the optimum dimensional relationship for the various components of the invention described above and in FIGS. 1 through 7 include variations in size, materials, shape, form, function, and manner of operation, assembly and use, are deemed readily apparent and obvious to one skilled in the art, and all equivalent relationships to those illustrated in the drawings and described in the specification are intended to be encompassed by the invention.

It shall be noted that those skilled in the art will readily recognize numerous adaptations and modifications which can be made to the various embodiments of the present invention which will result in an improved invention, yet all of which will fall within the spirit and scope of the present invention as defined in the following claims. Accordingly, the invention is to be limited only by the scope of the following claims and their equivalents.

The inventor claims:

1. A collapsible outdoor shower comprising a superior structure, a capture pan, and a lateral bracing structure;

wherein the lateral bracing structure secures the capture pan to the superior structure;

wherein the superior structure suspends the collapsible outdoor shower from an externally provisioned structure;

wherein the collapsible outdoor shower is a temporary structure deployed to create a private space for a client that is used for showering;

wherein the lateral bracing structure forms the private space that encloses the client;

wherein the capture pan forms a protected surface on which the client stands while in the private space;

wherein the superior structure comprises a superior ring, a plurality of spokes, a hub, a hook, a shower head, and a plurality of handles;

wherein the superior ring is a ring shaped structure;

wherein the superior ring forms an open congruent end of the structure formed by the lateral bracing;

wherein the superior ring attaches the superior structure to the lateral bracing;

wherein the plurality of handles attach to the superior ring;

wherein the hub is a mechanical structure;

wherein the hub is positioned at the center of the ring structure of the superior ring such that the center of the hub and the center of the superior ring form a line that is aligned with the vertical direction;

wherein the plurality of spokes physically secures the hub to the superior ring such that the hub is at the center of the superior ring;

wherein the superior ring is a rigid structure;

wherein the hook attaches to the superior surface of the hub;

wherein the hub contains the shower head.

2. The collapsible outdoor shower according to claim 1 wherein the plurality of spokes further comprises a first spoke, a second spoke, and a third spoke;

wherein the first spoke is a first structure selected from the plurality of spokes that attaches the superior ring to the hub;

wherein the second spoke is a second structure selected from the plurality of spokes that attaches the superior ring to the hub;

wherein the third spoke is a third structure selected from the plurality of spokes that attaches the superior ring to the hub;

wherein the plurality of spokes transfers the loads of the superior ring, the capture pan, and the lateral bracing to the hub when the collapsible outdoor shower is suspended for deployment;

wherein the relative positions of each of the plurality of spokes is such that the angle between any two adjacent spokes selected from the plurality of spokes is equal.

3. The collapsible outdoor shower according to claim 2
wherein the hook is a mechanical structure;
wherein the hook suspends the hub from the externally provisioned structure;
wherein the shower head is a nozzle structure;
wherein the shower head receives water under pressure from an externally provisioned source of water and discharges the received water as a spray into the private space of the collapsible outdoor shower;
wherein the shower head mounts in the interior space of the hub such that the hub forms a protective shell around the shower head;
wherein each of the plurality of handles is a grip that attaches to the superior ring;
wherein each of the plurality of handles allows for both carrying and manipulating the collapsible outdoor shower.

4. The collapsible outdoor shower according to claim 3
wherein the capture pan is a mechanical structure;
wherein the capture pan forms the capture pan of the collapsible outdoor shower when the collapsible outdoor shower is deployed;
wherein the capture pan forms a physical barrier that allows the client;
wherein the capture pan drains the water that falls on the capture pan out of the private space formed by the collapsible outdoor shower.

5. The collapsible outdoor shower according to claim/ wherein the capture pan comprises an inferior ring and an inferior pan;
wherein the inferior ring is a ring shaped structure;
wherein the inferior ring is a rigid structure;
wherein the inferior ring forms an open congruent end of the structure formed by the lateral bracing;
wherein the inferior ring attaches the capture pan to the lateral bracing;
wherein the inferior pan is a mechanical structure;
wherein the inferior pan is geometrically similar to the characteristic aperture formed by the ring structure of the inferior ring;
wherein the inferior pan attaches to the inferior ring such that the inferior pan encloses the open congruent end of the structure of the lateral bracing;
wherein the inferior pan forms the physical barrier between the client and the ground.

6. The collapsible outdoor shower according to claim 5
wherein the lateral bracing is a mechanical structure;
wherein the lateral bracing is a collapsible structure;
wherein by collapsible is meant that the span of the length of the center axis of the structure formed by the lateral bracing is adjustable;
wherein the lateral bracing forms a vertical barrier that creates the private space of the collapsible outdoor shower.

7. The collapsible outdoor shower according to claim 6
wherein the lateral bracing forms an openwork framework that is enclosed by a sheeting structure;
wherein the open framework of the lateral bracing forms the structure of the lateral bracing;
wherein the open framework of the lateral bracing forms the collapsible elements of the lateral bracing;
wherein the sheeting of the bracing that encloses the openwork framework is a flexible structure;
wherein the sheeting of the bracing is a hydrophobic structure;
wherein the sheeting structure is a mildew resistance structure;
wherein the sheeting of the bracing is an opaque structure;
wherein the sheeting of the bracing forms the vertically oriented barriers that form the private space of the collapsible outdoor shower;
wherein the sheeting of the bracing is a flexible structure that folds as the openwork framework is collapsed.

8. The collapsible outdoor shower according to claim 7
wherein the lateral bracing comprises a privacy sheeting, a privacy curtain, a plurality of c-rings, and a plurality of telescopic stanchions;
wherein each of the plurality of c-rings attaches to the privacy sheeting such that the privacy sheeting forms a vertically oriented barrier around the private space of the collapsible outdoor shower;
wherein the privacy sheeting is a textile;
wherein the privacy sheeting forms a portion of the sheeting structure that forms the private space;
wherein the privacy curtain is a textile;
wherein the privacy curtain encloses the opening in the private space that is formed by the plurality of c-rings;
wherein each of the plurality of telescopic stanchions is a stanchion that secures the plurality of c-rings, the superior ring, and the inferior ring to each other.

9. The collapsible outdoor shower according to claim 8
wherein each of the plurality of c-rings is a c-ring shaped structure;
wherein each of the plurality of c-rings is a rigid structure;
wherein each of the plurality of c-rings is identical;
wherein each of the plurality of c-rings mount in the lateral bracing such that the center of each of the plurality of c-rings are aligned;
wherein the line formed by the centers of each of the plurality of c-rings forms the center axis of the structure formed by the lateral bracing;
wherein each of the open sections of the c structure of each of the plurality of c-rings are aligned such that the open spaces combine to form an entryway into the private space of the collapsible outdoor shower.

10. The collapsible outdoor shower according to claim 9
wherein the plurality of c-rings comprises a first c-ring, a second c-ring, a third c-ring, and a fourth c-ring;
wherein the first c-ring is the c-ring selected from the plurality of c-rings that is proximal to the superior ring;
wherein the fourth c-ring is the c-ring selected from the plurality of c-rings that is proximal to the inferior ring;
wherein the second c-ring is the c-ring selected from the plurality of c-rings that is between the first c-ring and the third c-ring;
wherein the third c-ring is the c-ring selected from the plurality of c-rings that is between the second c-ring and the fourth c-ring;
wherein each of the plurality of c-rings is secured to the privacy sheeting.

11. The collapsible outdoor shower according to claim 10
wherein the privacy sheeting comprises a first rouleau, a second rouleau, a third rouleau, a fourth rouleau, a fifth rouleau, and a sixth rouleau;
wherein the first rouleau is a rouleau that is formed along the perimeter of the textile structure of the privacy sheeting;
wherein the superior ring inserts into the first rouleau to secure the superior structure to the privacy sheeting;
wherein the sixth rouleau is a rouleau that is formed on the perimeter of the privacy sheeting that is distal from the first rouleau;
wherein the inferior ring inserts into the sixth rouleau to secure the inferior ring to the privacy sheeting;

wherein the second rouleau is a rouleau that is formed on the face of the privacy sheeting;

wherein the first c-ring inserts into the second rouleau to secure the first c-ring to the privacy sheeting;

wherein the third rouleau is a rouleau that is formed on the face of the privacy sheeting;

wherein the second c-ring inserts into the third rouleau to secure the second c-ring to the privacy sheeting;

wherein the fourth rouleau is a rouleau that is formed on the face of the privacy sheeting;

wherein the third c-ring inserts into the fourth rouleau to secure the third c-ring to the privacy sheeting;

wherein the fifth rouleau is a rouleau that is formed on the face of the privacy sheeting;

wherein the fourth c-ring inserts into the fifth rouleau to secure the fourth c-ring to the privacy sheeting.

12. The collapsible outdoor shower according to claim 11 wherein the privacy curtain attaches to the superior ring of the superior structure;

wherein the privacy curtain further comprises a curtain sheeting and a curtain rod;

wherein the curtain sheeting is a textile panel;

wherein the curtain sheeting encloses the opening formed by the plurality of c-rings after the client has entered the private space;

wherein the curtain rod is a mechanical structure that suspends the curtain sheeting to the superior ring of the superior structure;

wherein the curtain rod attaches to the curtain sheeting to the superior ring such that the curtain sheeting will slide along the superior ring.

13. The collapsible outdoor shower according to claim 12 wherein each of the plurality of telescopic stanchions is a composite structure;

wherein each of the plurality of telescopic stanchions is a telescopic structure such that the span of the length of the center axis of each of the plurality of telescopic stanchions is adjustable;

wherein the span of the distance between the superior ring and the plurality of c-rings adjusts by adjusting the span of the length of the center axis of each of the plurality of telescopic stanchions;

wherein the span of the distance between the inferior ring and the plurality of c-rings adjusts by adjusting the span of the length of the center axis of each of the plurality of telescopic stanchions;

wherein the span of the distance between any two adjacent c-rings selected from the plurality of c-rings adjusts by adjusting the span of the length of the center axis of each of the plurality of telescopic stanchions.

14. The collapsible outdoor shower according to claim 13 wherein the plurality of telescopic stanchions comprises a first telescopic stanchion;

wherein the first telescopic stanchion is a telescopic structure that comprises a first arm, a second arm, and a first detent;

wherein the first detent is a mechanical device that locks and secures the first arm to the second arm;

wherein the first arm is a hollow structure that is further defined with an inner dimension;

wherein the second arm is a hollow structure that is further defined with an outer dimension;

wherein the second arm is geometrically similar to the first arm;

wherein the span of the outer dimension of the second arm is lesser than the span of the inner dimension of the first arm such that the second arm inserts into the first arm in a telescopic fashion to form a composite structure;

wherein the span of the length of the first telescopic stanchion adjusts by adjusting the relative position of the second arm within the first arm;

wherein the position of the second arm relative to the first arm is held in position using the first detent;

wherein the first telescopic stanchion further comprises a third arm and a second detent;

wherein the second detent is a mechanical device that locks and secures the third arm to the second arm;

wherein the second arm is further defined with an inner dimension;

wherein the third arm is a hollow structure that is further defined with an outer dimension;

wherein the third arm is geometrically similar to the second arm;

wherein the span of the outer dimension of the third arm is lesser than the span of the inner dimension of the second arm such that the third arm inserts into the second arm in a telescopic fashion to form a composite structure;

wherein the span of the length of the first telescopic stanchion adjusts by adjusting the relative position of the third arm within the second arm;

wherein the position of the third arm relative to the second arm is held in position using the second detent;

wherein the first telescopic stanchion further comprises a fourth arm and a third detent;

wherein the third detent is a mechanical device that locks and secures the fourth arm to the third arm;

wherein the third arm is further defined with an inner dimension;

wherein the fourth arm is a hollow structure that is further defined with an outer dimension;

wherein the fourth arm is geometrically similar to the third arm;

wherein the span of the outer dimension of the fourth arm is lesser than the span of the inner dimension of the third arm such that the fourth arm inserts into the third arm in a telescopic fashion to form a composite structure;

wherein the span of the length of the first telescopic stanchion adjusts by adjusting the relative position of the fourth arm within the third arm;

wherein the position of the fourth arm relative to the third arm is held in position using the third detent;

wherein the first telescopic stanchion further comprises a fifth arm and a fourth detent;

wherein the fourth detent is a mechanical device that locks and secures the fifth arm to the fourth arm;

wherein the fourth arm is further defined with an inner dimension;

wherein the fifth arm is a hollow structure that is further defined with an outer dimension;

wherein the fifth arm is geometrically similar to the fourth arm;

wherein the span of the outer dimension of the fifth arm is lesser than the span of the inner dimension of the fourth arm such that the fifth arm inserts into the fourth arm in a telescopic fashion to form a composite structure;

wherein the span of the length of the first telescopic stanchion adjusts by adjusting the relative position of the fifth arm within the fourth arm;

wherein the position of the fifth arm relative to the fourth arm is held in position using the fourth detent.

15. The collapsible outdoor shower according to claim 14 wherein the first arm rigidly attaches to both the superior ring and the first c-ring;

wherein the second arm rigidly attaches to both the second c-ring while simultaneously inserting into the first arm;

wherein the third arm rigidly attaches to both the third c-ring while simultaneously inserting into the second arm;

wherein the fourth arm rigidly attaches to both the fourth c-ring while simultaneously inserting into the third arm;

wherein the fifth arm rigidly attaches to both the inferior ring while simultaneously inserting into the fourth arm.

16. The collapsible outdoor shower according to claim 15 wherein the plurality of telescopic stanchions further comprises a second telescopic stanchion;

wherein the second telescopic stanchion is a telescopic structure that comprises a sixth arm, a seventh arm, and a fifth detent;

wherein the fifth detent is a mechanical device that locks and secures the sixth arm to the seventh arm;

wherein the sixth arm is a hollow structure that is further defined with an inner dimension;

wherein the seventh arm is a hollow structure that is further defined with an outer dimension;

wherein the seventh arm is geometrically similar to the sixth arm;

wherein the span of the outer dimension of the seventh arm is lesser than the span of the inner dimension of the sixth arm such that the seventh arm inserts into the sixth arm in a telescopic fashion to form a composite structure;

wherein the span of the length of the second telescopic stanchion adjusts by adjusting the relative position of the seventh arm within the sixth arm;

wherein the position of the seventh arm relative to the sixth arm is held in position using the fifth detent;

wherein the second telescopic stanchion further comprises an eighth arm and a sixth detent;

wherein the sixth detent is a mechanical device that locks and secures the eighth arm to the seventh arm;

wherein the seventh arm is further defined with an inner dimension;

wherein the eighth arm is a hollow structure that is further defined with an outer dimension;

wherein the eighth arm is geometrically similar to the seventh arm;

wherein the span of the outer dimension of the eighth arm is lesser than the span of the inner dimension of the seventh arm such that the eighth arm inserts into the seventh arm in a telescopic fashion to form a composite structure;

wherein the span of the length of the second telescopic stanchion adjusts by adjusting the relative position of the eighth arm within the seventh arm;

wherein the position of the eighth arm relative to the seventh arm is held in position using the sixth detent;

wherein the second telescopic stanchion further comprises a ninth arm and a seventh detent;

wherein the seventh detent is a mechanical device that locks and secures the ninth arm to the eighth arm;

wherein the eighth arm is further defined with an inner dimension;

wherein the ninth arm is a hollow structure that is further defined with an outer dimension;

wherein the ninth arm is geometrically similar to the eighth arm;

wherein the span of the outer dimension of the ninth arm is lesser than the span of the inner dimension of the eighth arm such that the ninth arm inserts into the eighth arm in a telescopic fashion to form a composite structure;

wherein the span of the length of the second telescopic stanchion adjusts by adjusting the relative position of the ninth arm within the eighth arm;

wherein the position of the ninth arm relative to the eighth arm is held in position using the seventh detent;

wherein the second telescopic stanchion further comprises a tenth arm and an eighth detent;

wherein the eighth detent is a mechanical device that locks and secures the tenth arm to the ninth arm;

wherein the ninth arm is further defined with an inner dimension;

wherein the tenth arm is a hollow structure that is further defined with an outer dimension;

wherein the tenth arm is geometrically similar to the ninth arm;

wherein the span of the outer dimension of the tenth arm is lesser than the span of the inner dimension of the ninth arm such that the tenth arm inserts into the ninth arm in a telescopic fashion to form a composite structure;

wherein the span of the length of the second telescopic stanchion adjusts by adjusting the relative position of the tenth arm within the ninth arm;

wherein the position of the tenth arm relative to the ninth arm is held in position using the eighth detent.

17. The collapsible outdoor shower according to claim 16 wherein the sixth arm rigidly attaches to both the superior ring and the first c-ring;

wherein the seventh arm rigidly attaches to both the second c-ring while simultaneously inserting into the sixth arm;

wherein the eighth arm rigidly attaches to both the third c-ring while simultaneously inserting into the seventh arm;

wherein the ninth arm rigidly attaches to both the fourth c-ring while simultaneously inserting into the eighth arm;

wherein the tenth arm rigidly attaches to both the inferior ring while simultaneously inserting into the ninth arm.

18. The collapsible outdoor shower according to claim 17 wherein the shower head further comprises a spray nozzle and a fitting;

wherein the spray nozzle is a mechanical structure that receives water under pressure from the fitting and discharges the water as a spray into the private space of the collapsible outdoor shower;

wherein the fitting is a mechanical structure that forms a fluidic connection between the spray nozzle and the water under pressure from an externally provisioned source of water;

wherein the inferior pan further comprises one or more scuppers;

wherein each of the one or more scuppers is an aperture formed through the inferior pan such that water that accumulates in the inferior pan drains out of the inferior pan through the one or more scuppers.

19. The collapsible outdoor shower according to claim 18 wherein the mildew resistance of the sheeting structure is derived by treating the sheeting structure with 5-chloro-2-(2,4-dichlorophenoxy)-phenol (CAS 3380-34-5).

* * * * *